US006393835B1

(12) United States Patent
Stoll et al.

(10) Patent No.: US 6,393,835 B1
(45) Date of Patent: May 28, 2002

(54) EXHAUST MUFFLER COMPRISING A CATALYTIC CONVERTER

(75) Inventors: Gerhard Stoll, Winnenden; Wolf Burger, Böblingen; Gustav Wölpert, Waiblingen; Thomas Rieger, Ingolstadt-Etting; Ronald Hotz, Urbach; Bernhard Dürr, Stuttgart, all of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/762,048

(22) PCT Filed: Jul. 21, 1999

(86) PCT No.: PCT/EP99/05187

§ 371 (c)(1),
(2), (4) Date: Apr. 6, 2001

(87) PCT Pub. No.: WO00/08315

PCT Pub. Date: Feb. 17, 2000

(30) Foreign Application Priority Data

Aug. 1, 1998 (DE) ..... 198 34 822

(51) Int. Cl.[7] ..... F01N 3/10

(52) U.S. Cl. ..... 60/299; 60/302; 60/323; 181/231; 181/222; 181/240; 181/272; 181/258

(58) Field of Search ..... 60/299, 302, 305, 60/314, 322, 323; 181/212, 222, 231, 240, 258, 272

(56) References Cited

U.S. PATENT DOCUMENTS

| | | | | | |
|---|---|---|---|---|---|
| 4,867,270 | A | * | 9/1989 | Wissmann et al. | 181/231 |
| 4,890,690 | A | * | 1/1990 | Fischer et al. | 181/240 |
| 5,139,107 | A | * | 8/1992 | Nagai | 181/240 |
| 5,338,903 | A | * | 8/1994 | Winberg | 181/231 |
| 5,440,083 | A | * | 8/1995 | Masuda | 181/240 |
| 5,521,339 | A | * | 5/1996 | Despant et al. | 181/230 |
| 5,738,184 | A | * | 4/1998 | Masuda et al. | 181/262 |
| 5,857,327 | A | * | 1/1999 | Sato et al. | 60/302 |

* cited by examiner

*Primary Examiner*—Thomas Denion
*Assistant Examiner*—Binh Tran
(74) *Attorney, Agent, or Firm*—Walter Ottesen

(57) ABSTRACT

The invention relates to an exhaust-gas muffler on an internal combustion engine in a motor chain saw. The exhaust-gas muffler includes a housing (1) which is assembled of two housing shells (2, 3). The one housing shell (2) has an exhaust-gas inlet (4) and the other housing shell (3) has an exhaust-gas outlet (5). An inner wall (8) as well as a catalytic converting element (7) are provided in the inner space (6) of the muffler housing (1). The catalytic converting element (7) is mounted between the exhaust-gas inlet (4) and the exhaust-gas outlet (5). In order to ensure an adequate catalytic converting treatment of the exhaust gas at low gas counterpressure, it is provided to divide the entering exhaust-gas flow (10) and to conduct at least one of these component flows (23) in contact with the catalytic converting element (7). The component flows (22, 23) are brought together and mixed with other before exiting from the muffler housing (1).

28 Claims, 15 Drawing Sheets

EXHAUST MUFFLER COMPRISING A CATALYTIC CONVERTER

FIELD OF THE INVENTION

The invention relates to an exhaust-gas muffler on an internal combustion engine in a handheld work apparatus such as a motor chain saw or the like.

BACKGROUND OF THE INVENTION

Such an exhaust-gas muffler is known from WO 97/01023. An inner wall partitions the inner space of the muffler housing into an inlet end chamber and an outlet end chamber. The partition wall is configured as a double wall and carries a catalytic coating. On the inner wall, the partition wall, which lies transverse to the entering exhaust-gas flow, is provided with a plurality of inlet openings in order to conduct the exhaust gas intensely swirled into the intermediate space of the partition wall. The catalytic treatment takes place in this intermediate space. The exhaust-gas flow can enter via only one outlet opening into the outlet end chamber and flow from there out of the exhaust-gas outlet into the atmosphere.

For an exhaust-gas conductance of this kind, the catalytic converter has to be configured for the throughflow of the entire quantity of the exhaust-gas flow. In this connection, care must be taken that the gas counterpressure which builds up does not become too high so that it leads to power deterioration of the internal combustion engine. Here, it is especially to be considered that such exhaust-gas mufflers are regularly flange connected to two-stroke engines, especially slit-controlled two-stroke engines, which react with sensitivity to changes in the exhaust-gas path as to their power characteristic.

SUMMARY OF THE INVENTION

It is an object of the invention to improve an exhaust-gas muffler of the kind described above so that an adequate catalytic treatment of the exhaust gas in ensured at a low gas counterpressure.

The exhaust-gas flow, which flows into the muffler housing, is subdivided into component quantities. Only one of the component quantities is guided over the catalytic converting element and, after catalytic treatment, is joined to the previously branched-off component quantity. In this way, on the one hand, the catalytic converting element can be configured as to its structural size such that only a slight gas counterpressure is built up while there is an adequate catalytic treatment of the component flow. Furthermore, a reduction of the temperature level of the treated exhaust gas is possible because of the mixing of the treated exhaust-gas flow with the untreated exhaust-gas flow so that the exiting exhaust-gas flow lies in an acceptable temperature range notwithstanding the catalytic treatment of the energy rich exhaust gases of a two-stroke engine.

To split up the exhaust-gas flow, at least one conducting wall, which projects into the exhaust-gas flow, connects to the exhaust-gas inlet. In a preferred embodiment, the conducting wall is configured as an inlet pipe in whose pipe wall a plurality of outlet openings is introduced in the manner of a showerhead. Only a part of the outflow openings of the showerhead open into a catalytic converting element which is preferably carried by the inlet pipe. The catalytic converting element can comprise a housing pot which is itself made of a catalytic converting material or in which a catalytically effective material is accommodated, for example, an unordered weft or the like.

In another advantageous embodiment, two conducting walls, which lie approximately parallel to each other, delimit an inlet shaft into which the exhaust-gas inlet opens directly. At least one of the conducting walls carries a catalytic converting coating or comprises a catalytic converting material whereby the catalytic converting element is formed necessary for treating the exhaust gas. The conducting walls preferably define the legs of a U-shaped bracket whose base leg has an inlet opening coincident to the exhaust-gas inlet. The U-shaped bracket lies clamped between the bases of the housing shells.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
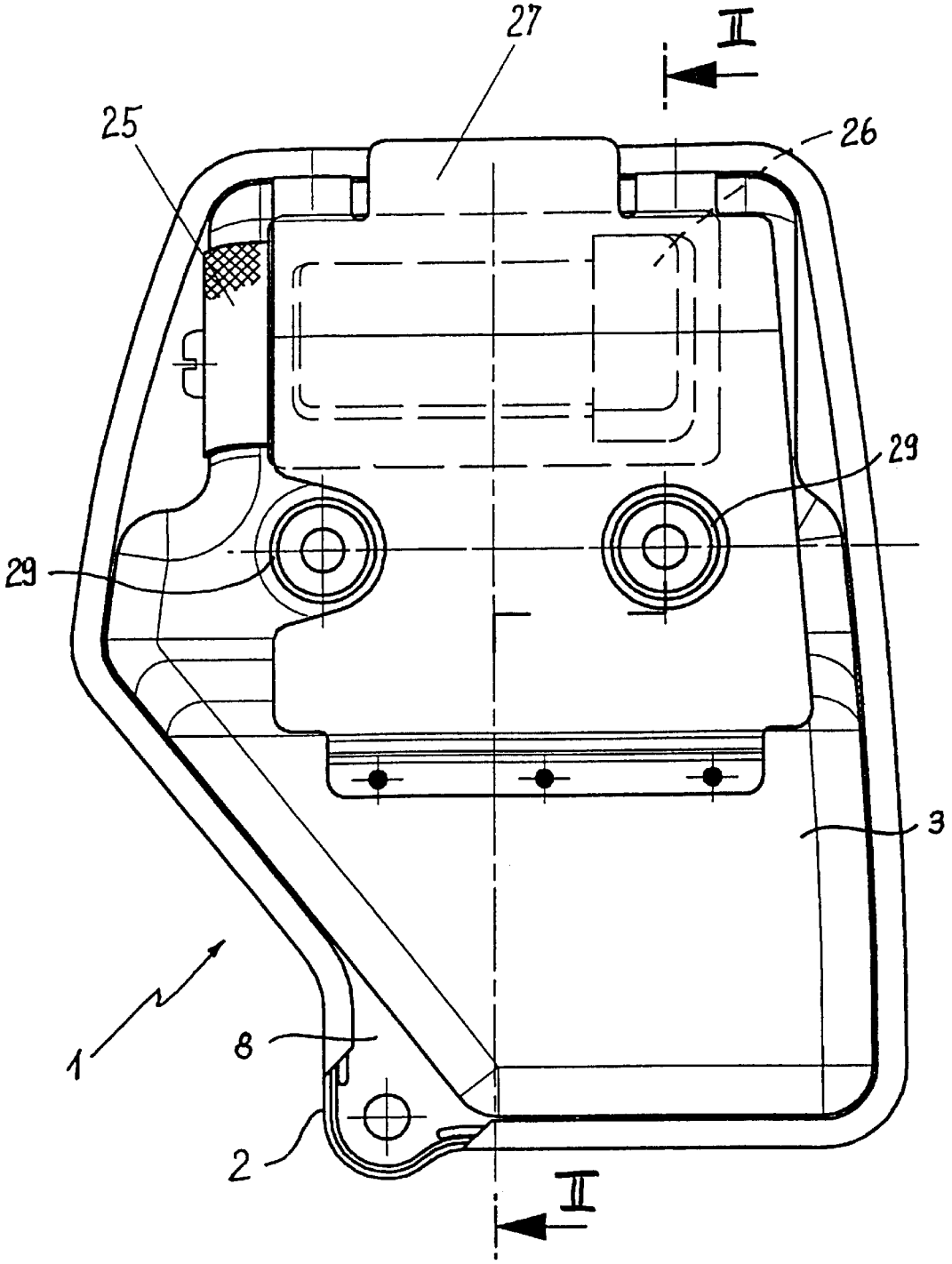
FIG. 1 shows an exhaust-gas muffler for an internal combustion engine in a handheld work apparatus as seen from the outlet end.

The exhaust-gas mufflers described below are attached directly to the cylinder of an internal combustion engine, for example, to an internal combustion engine in a handheld work apparatus such as a motor chain saw, a cuttoff machine, a brushcutter or the like. As an internal combustion engine, the following can be used: a two-stroke engine, a mixture-lubricated four-stroke engine, a separately-lubricated four-stroke engine or the like. The exhaust-gas mufflers described below comprise a housing 1 which is assembled of two housing shells 2 and 3. The one housing shell 2 has an exhaust-gas inlet 4 and is mounted directly on the exhaust-gas flange of the cylinder. The housing 1 further includes an exhaust-gas outlet 5 which is preferably provided in the other housing shell 3 and conducts the exhaust gas out of the muffler housing 1. A catalytic converting element 7 for treating the exhaust gas is mounted in the interior space 6 of the muffler housing 1 between the exhaust-gas inlet 4 and the exhaust-gas outlet 5.

Figure 2:
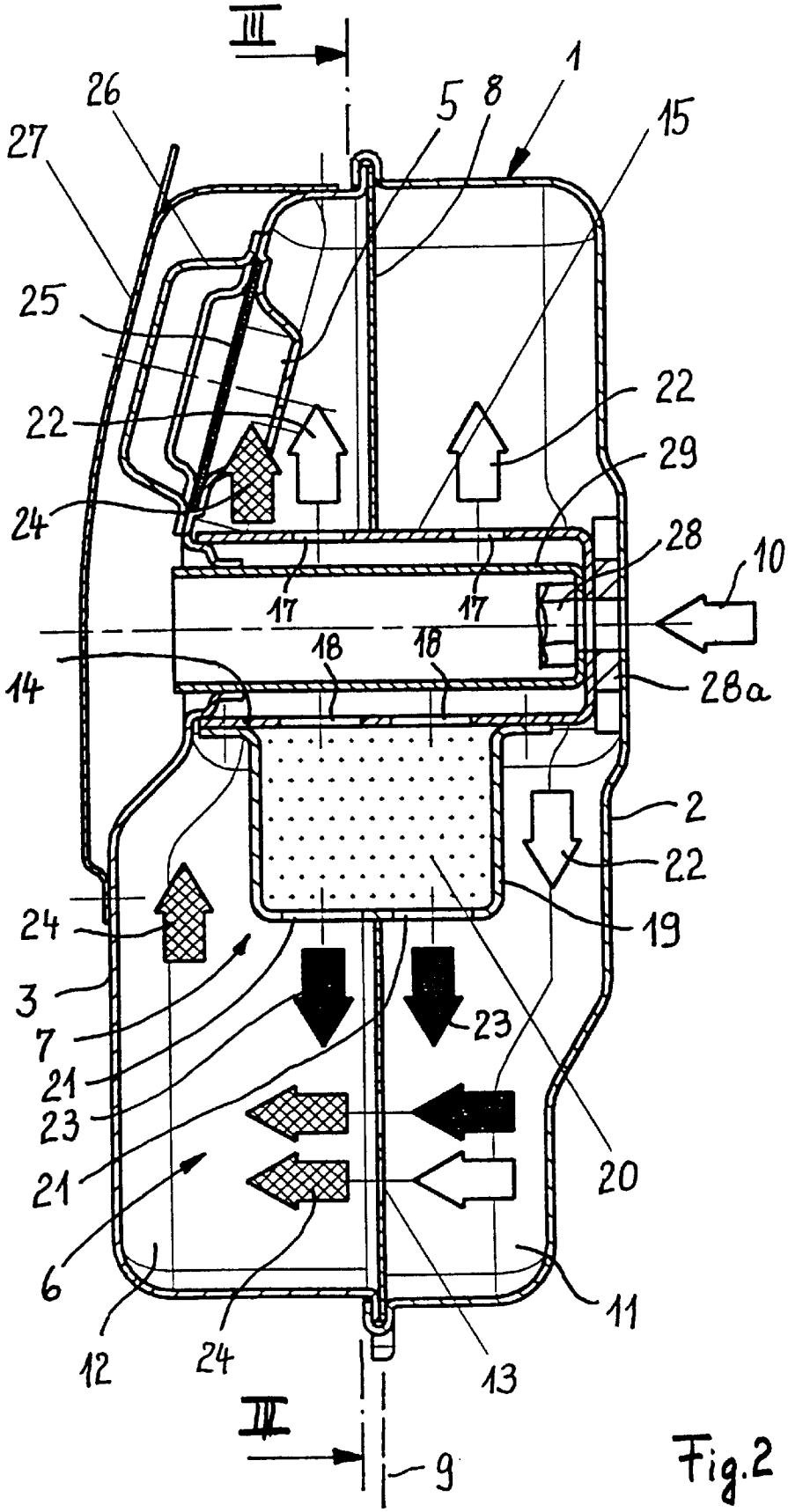
FIG. 2 shows a section view taken along line II—II of FIG. 1.
Figure 3:
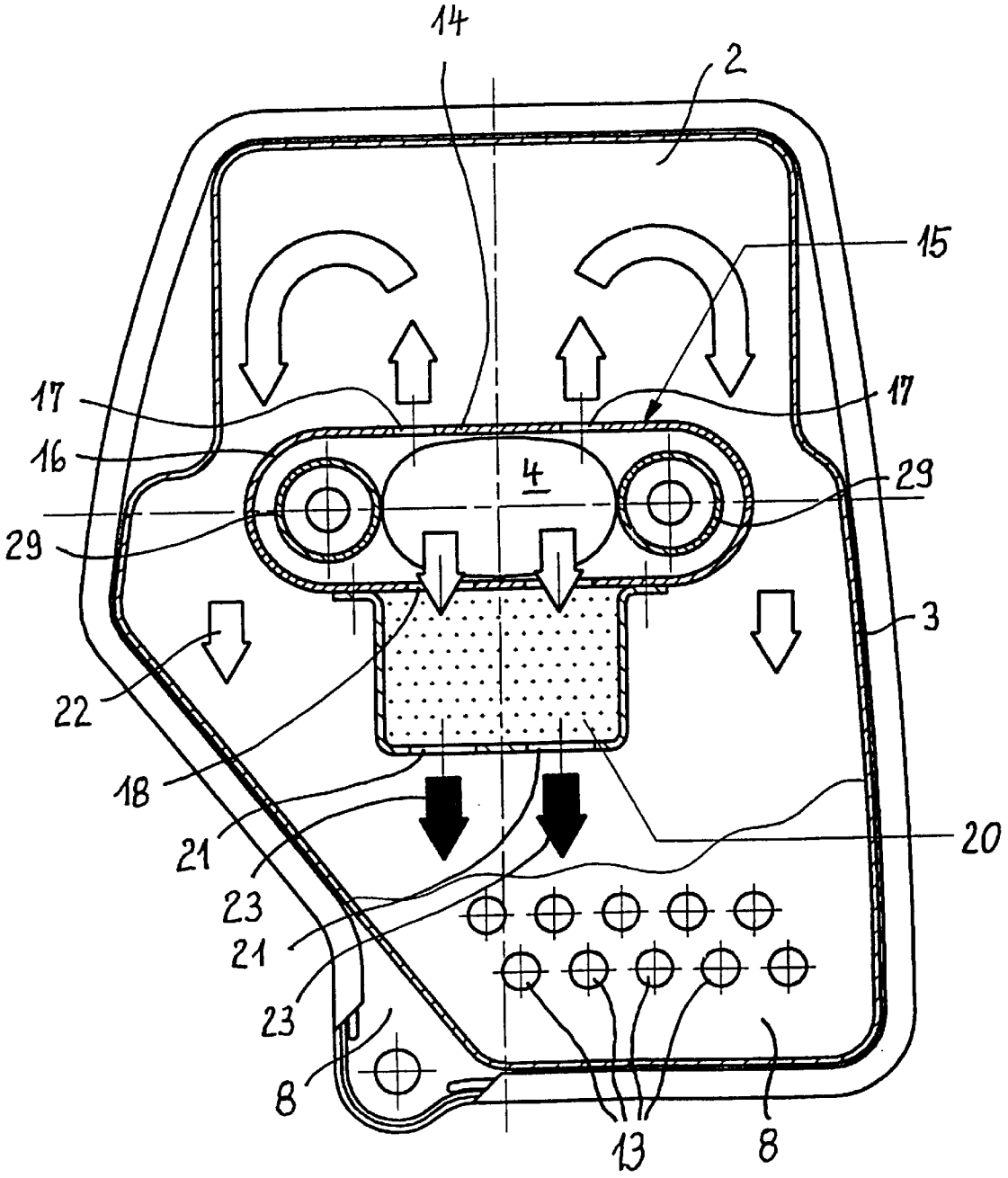
FIG. 3 shows a section view taken along line III—III in FIG. 2.
Figure 5:
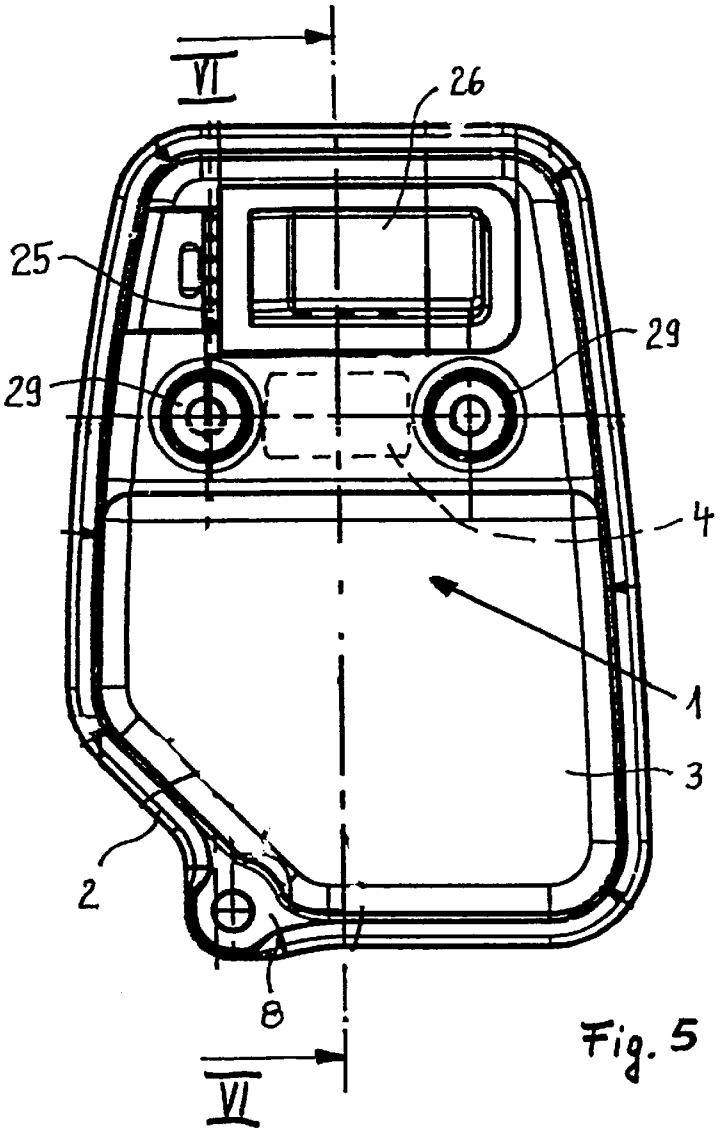
FIG. 5 shows a view onto the exhaust-gas muffler of FIG. 4 as seen from the outlet end.
Figure 4:
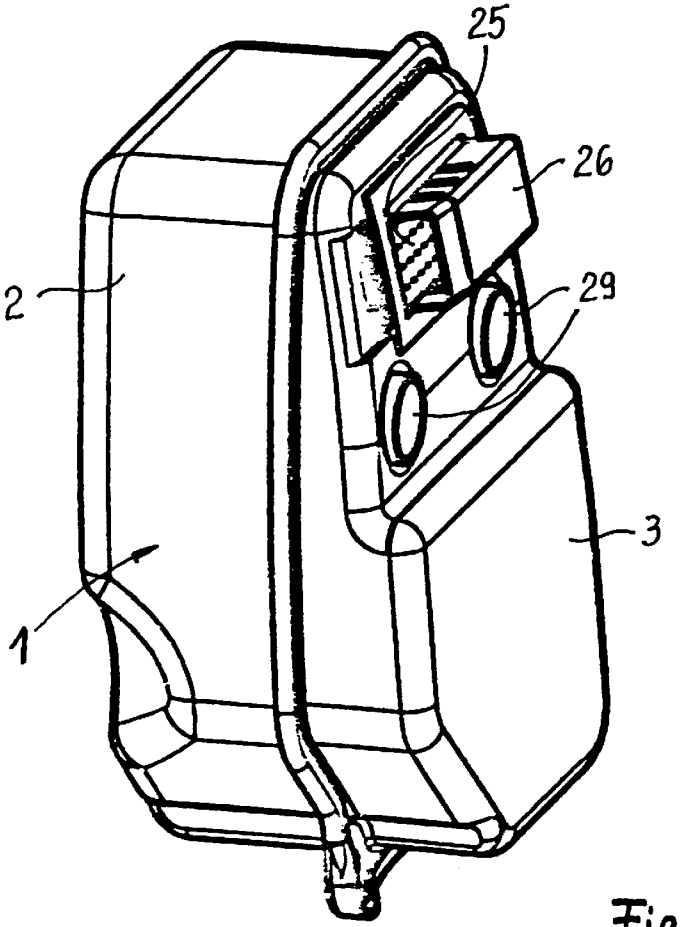
FIG. 4 shows an exhaust-gas muffler of another embodiment in a perspective view.
Figure 7:
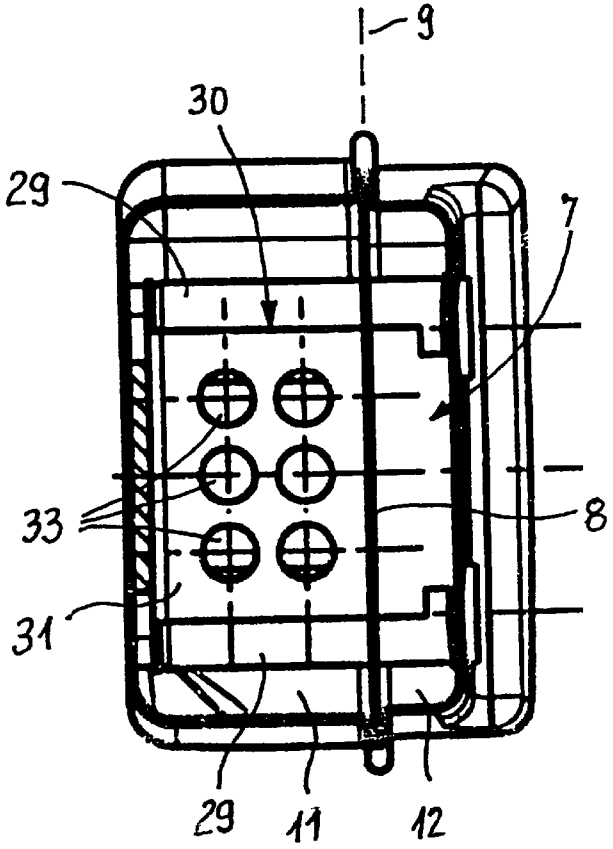
FIG. 7 shows a section view along line VII—VII of FIG. 6.

In the first embodiment of FIGS. 1 to 3 an intermediate wall 8 is mounted as an inner wall in the muffler housing 1. The intermediate wall 8 is preferably clamped tightly in the partition plane 9 of the housing shells 2 and 3 and partitions the inner space 6 into two separate chambers 11 and 12 and transversely to the inflow direction 10 of the exhaust gas. The chambers are in flow connection with each other via at least one connecting opening 13 in the intermediate walls. In the embodiment shown, several connecting openings 13 are provided.

As shown in FIG. 3, a conducting wall 14 which conducts the exhaust-gas flow, connects in the interior space 6 of the muffler housing 1 to the exhaust-gas inlet 4. The conducting wall 14 extends through the muffler housing 1 in the inflow direction 10 of the exhaust gas (FIG. 2) and lies, at its ends, against the housing shells (2, 3).

In the embodiment of FIGS. 1 to 3, the conducting wall 14 is formed by an inlet pipe 15 having a rectangular-oval cross section. A plurality of outlet openings (17, 18) are introduced into the pipe wall of the inlet pipe in the manner of a showerhead. The exhaust gas, which flows in via the exhaust-gas inlet 4 in in-flow direction 10, is distributed shower-like via the outflow openings (17, 18) into the interior space 6 of the muffler housing 1. The inlet pipe 15 projects through the intermediate wall 8 approximately perpendicularly. The outflow openings (17, 18) lie advantageously on the one side as well as on the other side of the partition wall 8 and open into the inlet side chamber 11 as well as into the outlet side chamber 12. It can be purposeful to arrange the outlet openings (17, 18) so that they open only into the inlet side chamber.

As shown in FIGS. 2 and 3, the outflow openings 18 open into a catalytic converting element 7 which is preferably held on the inlet pipe 15. In the embodiment shown, the catalytic converting element 7 comprises a housing pot 19 which can itself consist of a catalytic converting material or can, as shown in the embodiment, be filled with a catalytic converting material, for example, a weft 20 or the like. The catalytic converting element 7 lies in the intermediate wall 8 and the outlet openings 21 of the housing pot 19 open into the inlet end chamber 11 as well as into the outlet end chamber 12. An opening into one of the chambers (11, 12) or volumetrically divided gas flows into the chambers (11, 12) can be purposeful.

The untreated exhaust gas, which flows in the in-flow direction 10 into the showerhead-like inlet pipe 15, divides into first component flows 22 which exit untreated into the chambers 11 and 12 of the muffler housing 1. Separate component flows enter into the catalytic converting element 7 through the outlet openings 18 of the showerhead 15 and leave the catalytic converting element 7 as component flows 23 of treated gas through the outlet openings 21. The one component flow 23 enters into the inlet side chamber 11 and the other component flow 23 enters into the outlet side chamber 12. A mixing of the component flows 22 of untreated gas with the component flows 23 of treated exhaust gas takes place first in the housing chambers 11 and 12 separate from each other. The mixed flows 24 of the chamber 11 enter via the connecting openings 13 into the chamber 12 and mix there with the component flows which flow there and the mixture flows. In this way, a mixture flow 24 flows out of the exhaust-gas outlet 5. The exhaust-gas outlet 5 is covered by a spark protection lattice 25. As FIG. 1 shows in combination with FIG. 2, an exit scoop 26 is mounted on the exhaust-gas outlet 5 which determines the outflow direction of the exhaust gas exiting from the muffler 1. The exit scoop is effectively covered by an air conducting sheet metal piece 27 via which cooling air flowing from the engine is advantageously supplied and mixes with the exhaust gas to form a temperature-reduced exhaust-gas flow.

The division of the volumes of the component flows 22 and 23 takes place via an adapted selection of the diameters of the outflow openings whereby each volume flow can be varied as desired.

The exhaust-gas muffler is attached by means of short assembly screws to the cylinder of the engine. The assembly screws 28 are seated in bushing-like receiving sleeves 29 which extend through the muffler housing 1 and are open on the outlet end. In this way, a short screw can be introduced into the receiving sleeve 29 from the outlet end. The screw head lies on the base of the housing shell 2, advantageously by placing a pressure piece 28*a* therebetween. The receiving sleeves 29 lie within the showerhead-like inlet pipe 15 and are flushed by the inflowing exhaust gas. The receiving sleeves 29 lie approximately axially parallel with the inlet pipe 15.

The exhaust-gas muffler in the embodiment of FIGS. 4 to 10 corresponds in its basic configuration to that of the exhaust-gas muffler of FIGS. 1 to 3 and, for this reason, the same parts have the same reference numerals.

The exhaust-gas muffler is assembled from the housing shells 2 and 3. An intermediate wall 8 is mounted in the partition plane 9 and partitions the interior space 6 of the muffler 1 into an inlet end chamber 11 and an outlet end chamber 12.

An inlet shaft 13 connects to the exhaust-gas inlet 4 and is delimited by two conducting walls 31 and 32 lying parallel to each other. The exhaust-gas inlet 4 opens into the inlet shaft 30. At least one of the conducting walls (31, 32) carries a coating of a catalytic converting material. Preferably, both conducting walls (31, 32) are coated with a catalytic converting material or are made of a material of this kind.

The receiving sleeves 29 for assembly screws are mounted in the inlet shaft 30. The receiving sleeves 29 extend through the muffler housing 1 and fill the distance (a) between the conducting walls 31 and 32 with a pregivable play (s). Outflow openings 33 are arranged in one of the two conducting walls (31, 32), in the embodiment shown, for example, in the conducting wall 31. These outflow openings 33 open exclusively into the inlet end chamber 11 of the exhaust-gas muffler.

Figure 8:
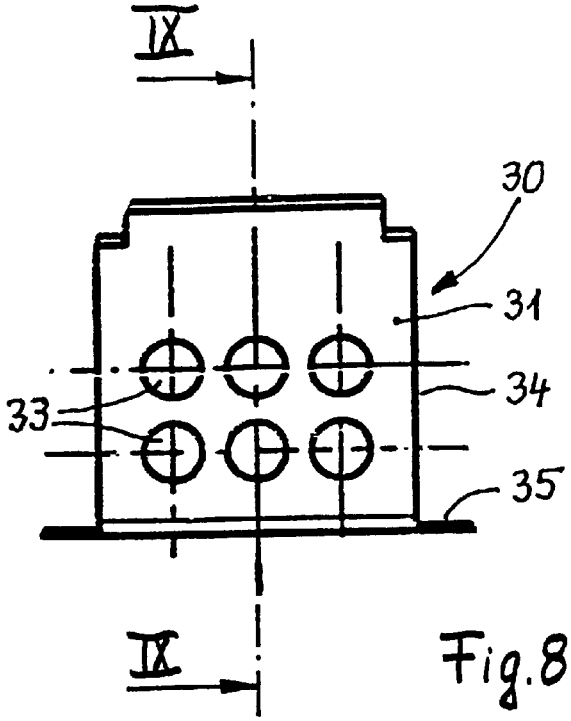
FIG. 8 shows a plan view of the catalytic converting element in accordance with FIG. 7.
Figure 9:
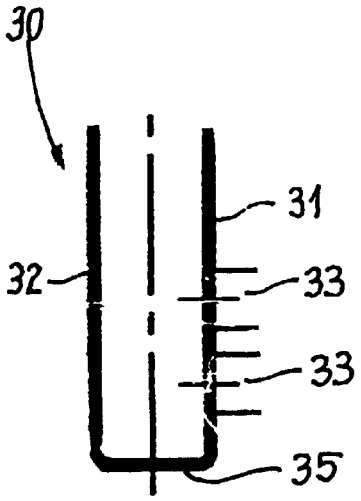
FIG. 9 shows a section view taken along line IX—IX of FIG. 8.
Figure 10:
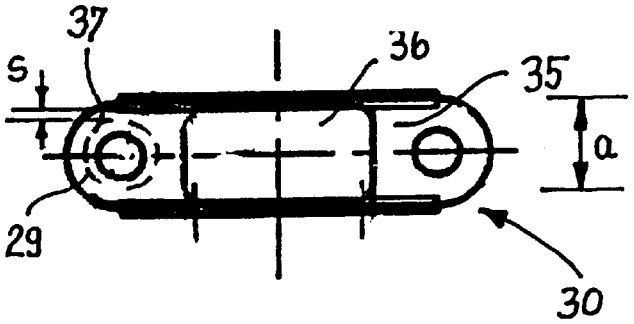
FIG. 10 is a plan view of the catalytic converting element in accordance with arrow X in FIG. 8.

As shown in FIGS. 8 to 10, the conducting walls (31, 32) are preferably provided as legs of a U-shaped bracket 34 whose base leg 35 has an inflow opening 36 lying coincident to the exhaust-gas opening 4. From FIG. 10, it becomes clear that, depending upon the diameter of the receiving sleeves 29, a gap of width (s) is located in the longitudinal direction of the separating walls (31, 32) between the sleeves 29 and the conducting walls (31, 32). Untreated exhaust gas can flow out of the inlet shaft 30 via the gap.

Figure 6:
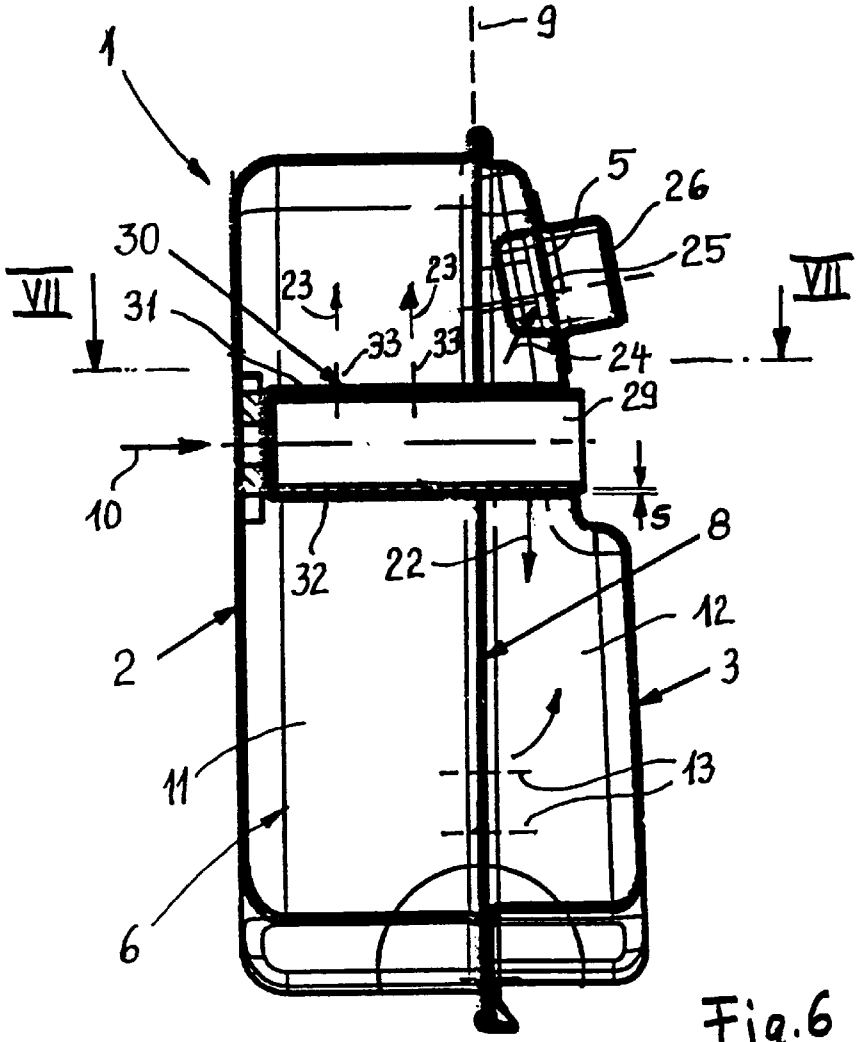
FIG. 6 shows a section view along line VI—VI of FIG. 5.

As shown in FIG. 6, the inlet shaft 30 projects through the partition wall 8 from the base of the inlet end housing shell 2 to the base of the outlet end housing shell 3. The gap 37 extends over the length of the receiving sleeves 29 and over the inlet end chamber 11 as well as over the outlet end chamber 12.

Exhaust gas, which enters in inflow direction 10 through the exhaust-gas inlet 4 and the inflow opening 36 into the inlet shaft 30, is treated catalytically in a component quantity which exits via the outflow openings 33 as a component flow 23 into the inlet end chamber 11. Substantially untreated exhaust gas passes as component flow 22 via the gap extending along the receiving sleeve 29 into the chamber 11 and out of the chamber 12. The component flow 23 of the treated exhaust gas mixes with the component flow 22 of the untreated exhaust gas in the chamber 11 and passes via connecting openings 13 into the chamber 12. There, the mixed flow 24 intersperses with a further component flow 22 of untreated exhaust gas and leaves the exhaust-gas muffler in a directed manner via the exhaust-gas outlet 5, the spark protective lattice 25 and the outlet hood 26.

The play (s) between the receiving sleeve 29 and the conducting walls 31 and 32 of the in let shaft 30 can be structurally pregiven whereby the length of the exhaust gas, which flows untreated via the gap 37 out to the inlet shaft 30, can be pregiven. If the gap 37 is selected to be very narrow, then essentially only the exhaust gas passes out through the gap 37 which passes along the conducting walls (31, 32) and is therefore treated. If the play (s) is selected larger, then the component quantities of untreated exhaust gas become greater. If the play (3) is selected to be zero, then the inflowing exhaust gas can exit exclusively via the outflow openings 33 into the chamber 11 of the muffler housing 1 as a substantially treated exhaust-gas flow and flows then via the connecting openings 13 and the chamber 12 to the exhaust-gas outlet 5.

While in both the above-described embodiments, a division of the exhaust-gas flow is undertaken directly after the entry into the muffler housing, in accordance with FIGS. 11 to 14, the untreated exhaust gas flows first into the inlet end chamber 11 and is subdivided by the partition wall B into two component flows. A component flow 22 of untreated exhaust gas flows via the connecting openings 13 into the outlet end chamber 12; whereas, another component flow 23' flows via connecting openings 13' into a catalytic converting element 7. The treated exhaust gas exits as component flow 23 from outlet openings 21 of the catalytic converting element 7 into the outlet end housing chamber 12 and there mixes with the untreated exhaust gas 22 and is conducted as a mixture flow 24 via the outlet 5. The mixture flow flows through a spark protective lattice 25 and is directly discharged via an exit scoop 26.

The division of the exhaust-gas flow into untreated component flows 22 and treated component flows 23 takes place because of the number and size of the connecting openings 13 and 13' in the intermediate wall 8. If the connecting openings 13 are configured to be very small, then a large component flow 23' enters into the catalytic converting element 7. If the connecting openings 13 are omitted, then the entire exhaust-gas flow, which enters through the exhaust-gas inlet between the receiving sleeves 29, is guided over the catalytic converting element 7 and treated before it flows off via the exhaust-gas outlet 5.

Figure 12:
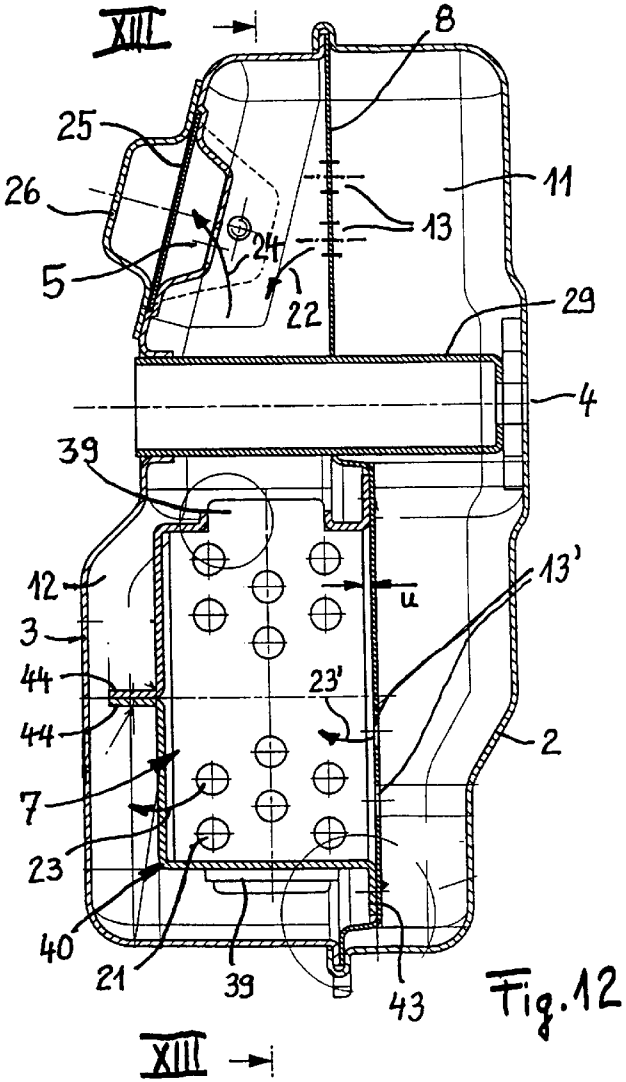
FIG. 12 is a section view taken along line XII—XII in FIG. 11.
Figure 11:
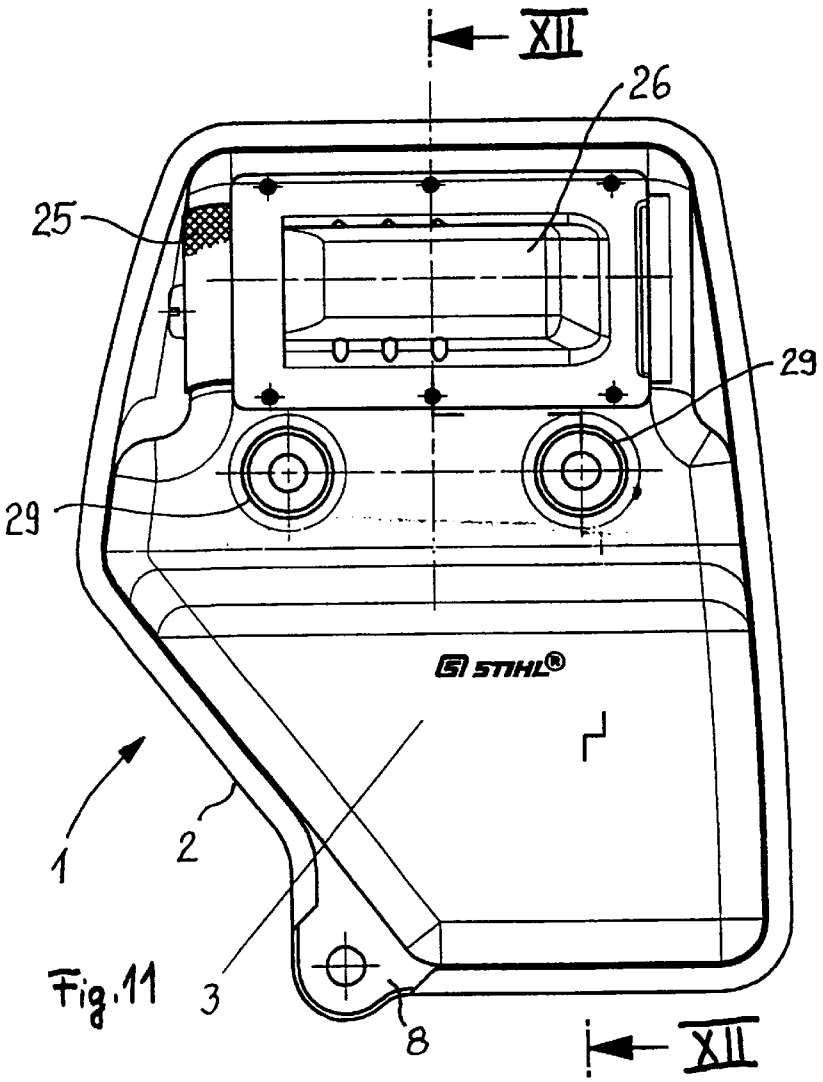
FIG. 11 is a further embodiment of an exhaust-gas muffler as seen from the outlet end.
Figure 13:
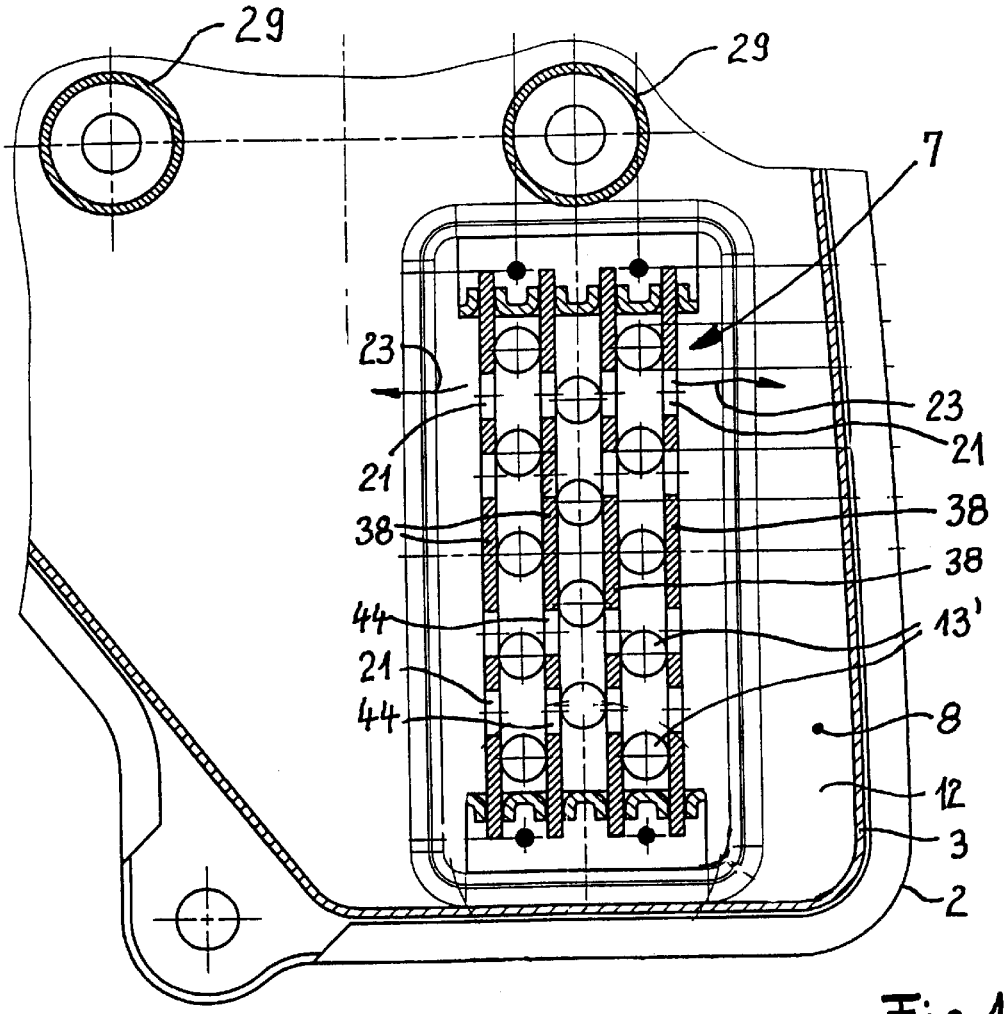
FIG. 13 shows, enlarged, a section along line XIII—XIII of FIG. 12.
Figure 14:
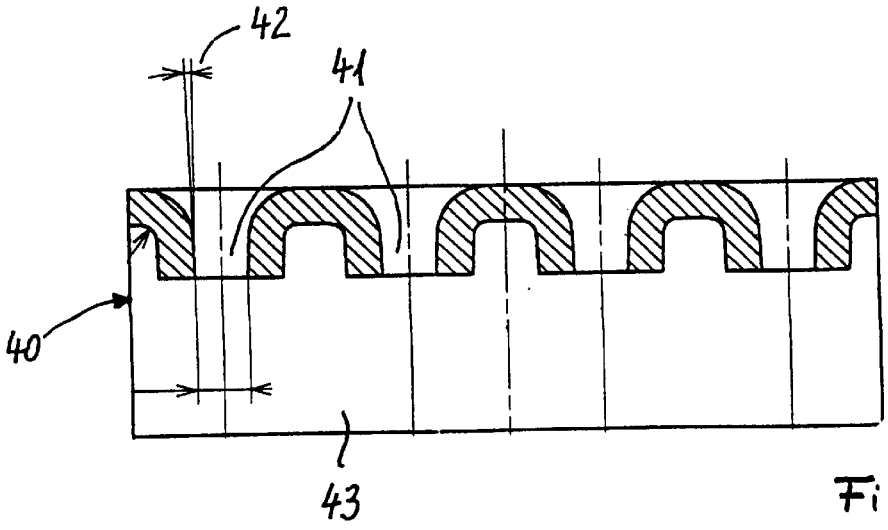
FIG. 14 shows, enlarged, a holding angle for the catalytic converting sheet metal pieces.

The catalytic converting element 7 is purposefully mounted in the outlet end housing chamber 12 and comprises (similar to the bracket-shaped catalytic converting element 7 according to FIGS. 8 to 10) individual catalytic converting plates 38 which lie approximately parallel to each other (FIG. 13). The catalytic converting plates 38 have holding flags 39 (FIG. 12) on opposite-lying edges. The catalytic converting sheet metal pieces are rectangularly shaped when viewed in plan. The holding flags 39 are provided on the narrow sides. With the holding flags 39, the catalytic converting sheet metal pieces 38 are inserted into holding angles 40. For this purpose, receiving slits 41 are formed in the holding angles. The opposite-lying walls of the holding angles run slightly toward each other in the insert direction at an angle 42 so that the holding flags 39 are held clamped in the receiving slits 41.

As shown in FIGS. 12 and 13, the holding angles 40 are attached with a bent-over foot flange 43 to the partition wall 8, preferably by spot welding. The longitudinal edges of the catalytic converting sheet metal pieces lie at a slight spacing u to the intermediate wall 8. The holding angles 40 engage the catalytic converting plate pieces 38 at their narrow and longitudinal edges and lie against each other with leg edges 43*a* which face toward each other. The leg edges 43*a* are purposefully connected to each other, for example, by spot welding, so that the catalytic converting sheet metal pieces 38 are surrounded by the holding angles 40 in the manner of a cage and are attached to the intermediate wall 8.

As FIG. 13 shows, a plurality of connecting openings 13' lying one behind the other open between each two catalytic converting sheet metal pieces 38 so that between each two catalytic converting sheet metal pieces, component flows 23' of the untreated exhaust gas enter. The treated exhaust gas passes via the outlet openings 21 as component flow 23 into the outlet end housing chamber 12. The inner catalytic converting sheet metal pieces 38 have the throughflow openings 44 corresponding to outlet openings 21 in order to make possible a passover of the exhaust gas to the outflow openings 21.

Figure 15:
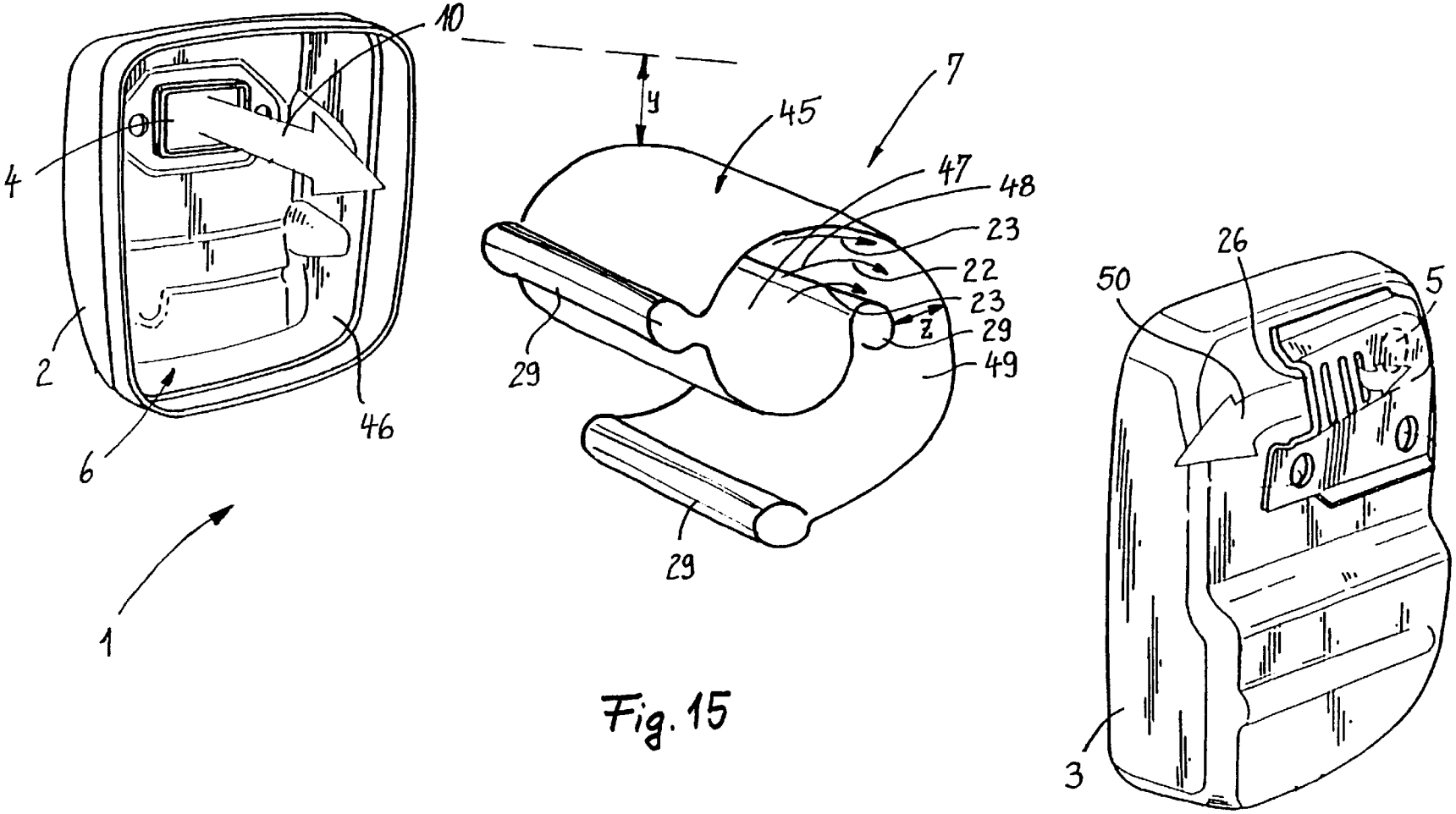
FIG. 15 shows an assembly schematic of an exhaust-gas muffler according to another embodiment.

The exhaust-gas muffler shown in the assembly schematic of FIG. 15 comprises, in its basic assembly, again a housing 1 which is assembled from housing shells 2 and 3. The exhaust-gas inlet 4 is in the base of the housing shell 2 and the exhaust-gas outlet 5 is provided in the base of the housing shell 3 and is covered by an exit scoop 26. The interior space 6 of the exhaust-gas muffler is subdivided by a conducting wall 45 in the inflow direction 10 of the exhaust gas. The exhaust gas is guided along the conducting wall 45 from the exhaust-gas inlet 4 to the exhaust-gas outlet 5. The conducting wall 45 lies transversely to the inflow direction 10 of the exhaust gas with a spacing y to the housing wall 46 so that an approximately spirally shaped running channel is formed between the housing wall 46 and the conducting wall 45. The channel runs along the conducting wall 45 from the exhaust-gas inlet 4 to the exhaust-gas outlet 5.

The exhaust gas, which flows in in the inflow direction 10, passes centrally into an approximately tube-shaped center section 47 of the spirally shaped conducting wall 45 and leaves this center section transversely to the inflow direction via the longitudinal gap 48 since the center section 47 lies at its ends at the respective bases of the housing shells 2 and 3. The end section 49 surrounds the center section 47 in the manner of a half circle. The exhaust-gas flow is then conducted via the end section 49 partially circularly or spirally around the exhaust-gas inlet 4 to the exhaust-gas outlet 5. The guided exhaust-gas flow is treated only in the component flows 23 guided along the conducting wall 45 because of the center section 47, which is configured large in diameter, and because of the large distance (y) of the conducting wall 45 to the housing wall 47 as well as the distance (z) between the outer end section 49 and the center section 47. On the other hand, a component flow 22, which is enclosed by the component flows 23, is entrained essentially untreated from the exhaust-gas inlet 4 to the exhaust-gas outlet 5. Because of the spark-protected lattice arranged in the exhaust-gas outlet and the exit scoop 26, the outflowing exhaust-gas flow 50 is a mixture flow which contains the component quantities of the component flows 22 and 23.

The conducting wall 45 is manufactured from a catalytic converting material or is made of sheet metal or the like coated with a catalytic converting material. Catalytic converting treatment takes place only in the regions next to the conducting wall because of the geometric configuration and the spatial arrangement of the guided exhaust-gas flow; whereas, a component quantity as exhaust-gas flow 22 flows untreated from the exhaust-gas inlet 4 to the exhaust-gas outlet 5 and is only there mixed with the treated component flow 23.

In a manner not shown in detail, the exhaust-gas muffler is threadably fastened with threaded bolts directly at the exhaust-gas outlet of the cylinder of an internal combustion engine with the threaded bolts projecting through the muffler housing. Receiving sleeves 29 for the threaded bolts are formed on the conducting wall 45.

Figure 16:
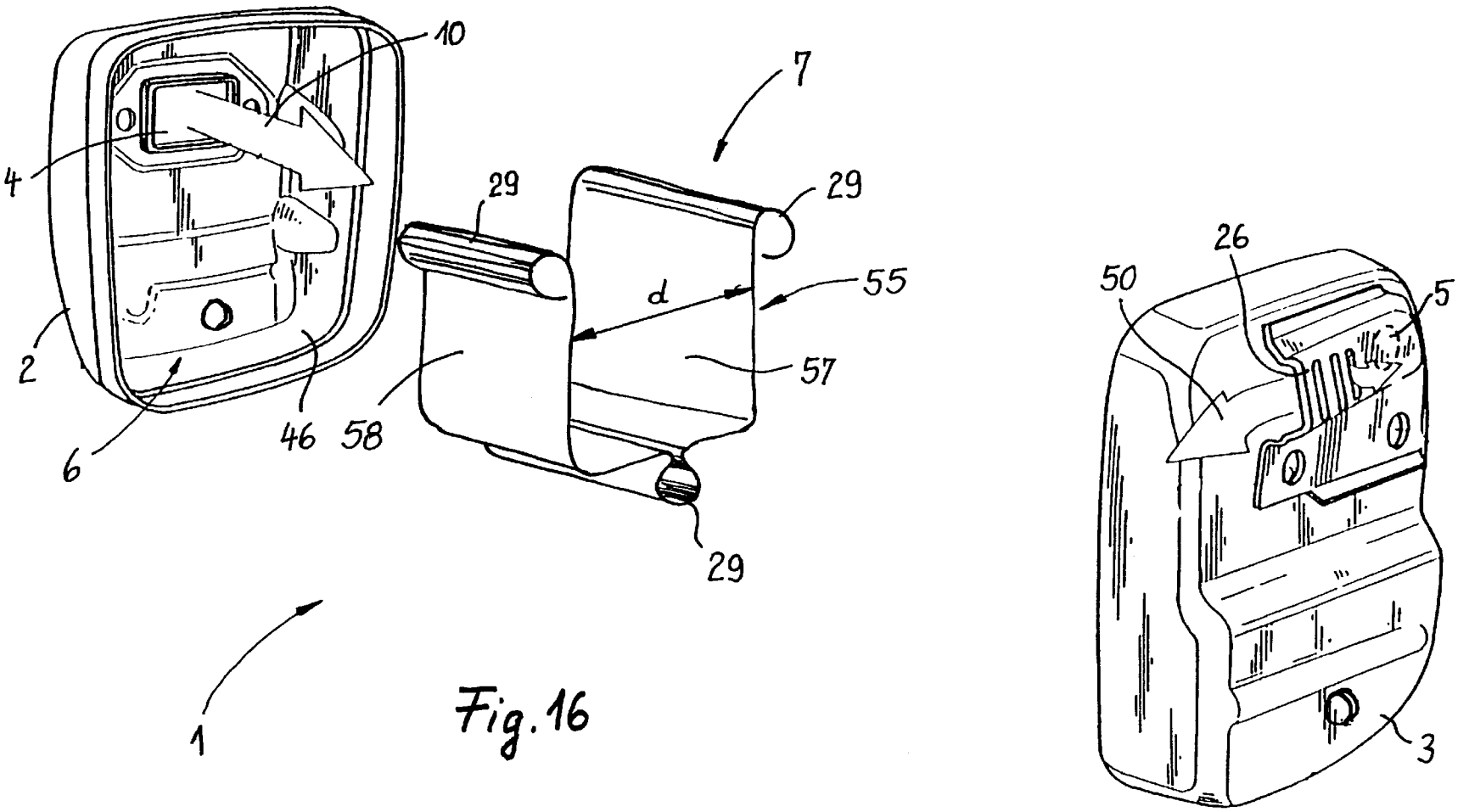
FIG. 16 shows an assembly schematic of an exhaust-gas muffler of another embodiment having a catalytic converting element deviating from FIG. 15.

The exhaust-gas muffler of FIG. 16 corresponds to the configuration of FIG. 15 except for the configuration of the conducting wall 55. For this reason, the same reference numerals are used for the same parts. The conducting wall is configured approximately U-shaped and the exhaust gas enters in the inflow direction 10 centrally between the legs 57 and 58. Because of the leg spacing (d), only the component flow of the exhaust gas which lies close to the conducting wall is treated and flows along the conducting wall 55 to the exhaust-gas outlet 5. There, the component quantities become mixed closely with each other when passing through the spark protective lattice and entering into the exit scoop 26 so that the exiting exhaust-gas flow 50 contains thoroughly mixed component flows of treated and untreated exhaust gas.

Figure 17:
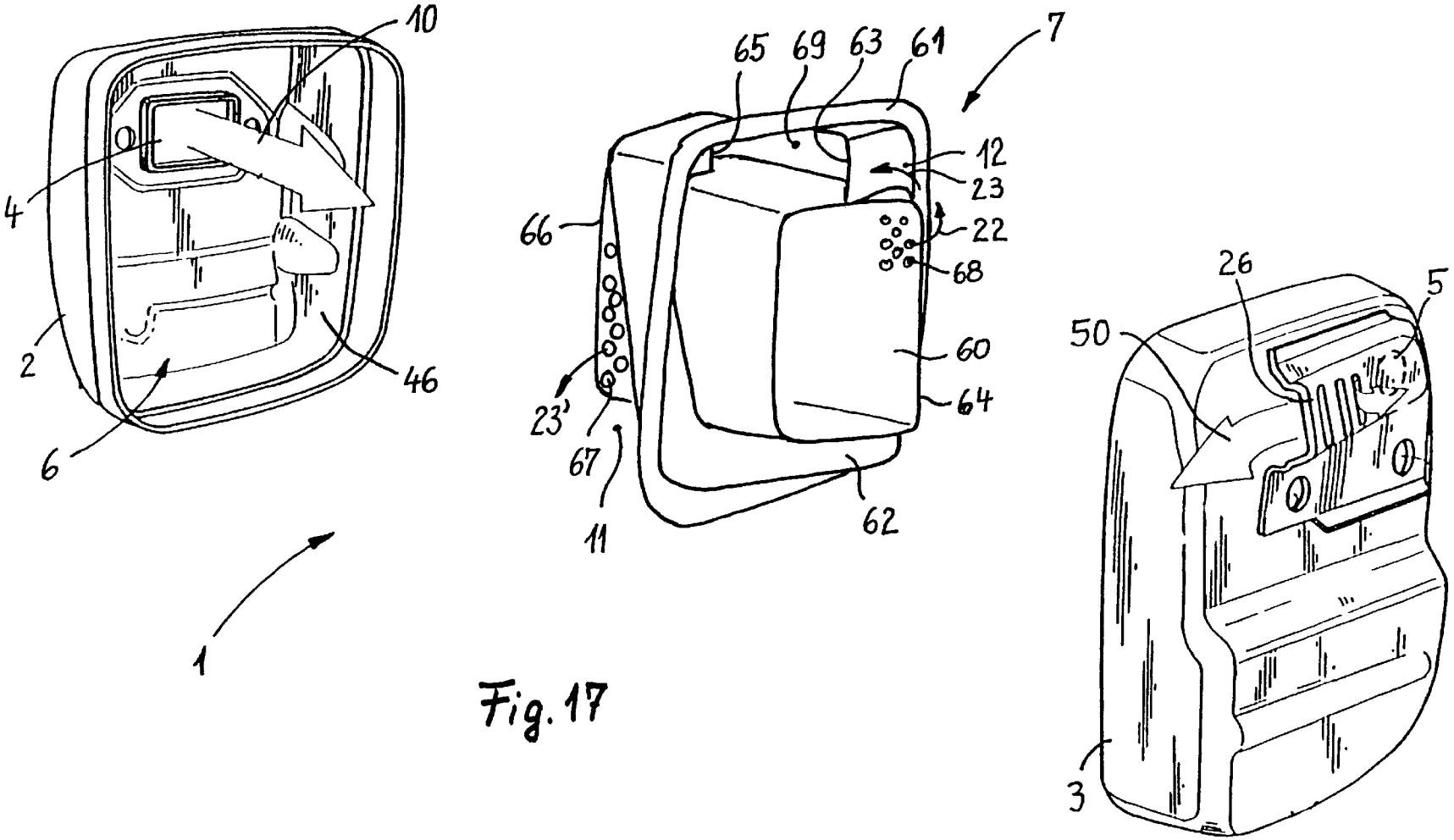
FIG. 17 shows an assembly schematic of another embodiment of the exhaust-gas muffler.

In the embodiment of FIG. 17, the outer housing of the exhaust-gas muffler corresponds to the embodiments described above. The same reference numerals are used for the same parts.

An entry pipe 60 is held between the bases of the housing shells 2 and 3 and this entry pipe is closed at its ends by the bases of the housing shells (2, 3). The entry pipe 60 is held in a frame 61 which lies substantially tight against the housing inner wall 46 and preferably is clamped on a shoulder 56 in the partition plane of the housing shells (2, 3).

A ramp 62 is formed between the frame 61 and the inlet pipe 60 and climbs along the inlet pipe 60 in a spiral manner. The ramp 62 is mounted in the annular space disposed between the inlet pipe 60 and the housing wall 46. The inlet pipe 60 is approximately rectangularly shaped when viewed in cross section. The ramp 62 climbs starting at the base of the housing shell 2 in a spiral shape about the inlet pipe 60 and lies against the base of the housing shell 3 with its end 63. The end 63 lies in a plane with the edge 64 of the end facing toward the housing shell 3. The end 65 lies in a plane with the edge 66 of the end facing toward the housing shell 2. The wall region of the inlet pipe 60 lying below the ramp 62 close to the forward end 65 has outflow openings 67. Outflow openings 68 can be provided in the wall region of the inlet pipe 60 lying above the ramp 62 next to the upper end 63.

With the ramp 62, the annular space between the inlet valve 60 and the housing wall 46 is subdivided into an inlet end chamber 11 below the ramp 62 and an outlet end chamber 12 above the ramp 62. Both chambers 11 and 12 are connected to each other by a window 69 formed between the ends 63 and 65 of the ramp.

The exhaust gas, which enters in the inflow direction 10, flows into the inlet pipe 60 and passes in component flows 23' out of the outflow openings 67 into the inlet chamber 11 of the muffler housing. The component flows 23' are now guided along the ramp 62 spirally about the inflow direction 10 of the exhaust gas, that is, about the inlet pipe 60 through the window 69 and into the outlet end chamber 12. The component flows 23' flow over their spirally shaped path along the catalytically converting coated ramp or the catalytically converting coated surface of the inlet pipe 60 and are converted. If outflow openings 68 are provided in the surface of the inlet pipe 60 which discharge component flows 22 of untreated exhaust gas into the outlet end chamber 12 directly next to the exhaust-gas opening 5, then this untreated exhaust gas mixes with the treated component flows flowing along the ramp and flows, together with these treated component quantities, as an exhaust-gas mixture flow 50 in a directed manner out of the exit scoop 26.

Figure 18:
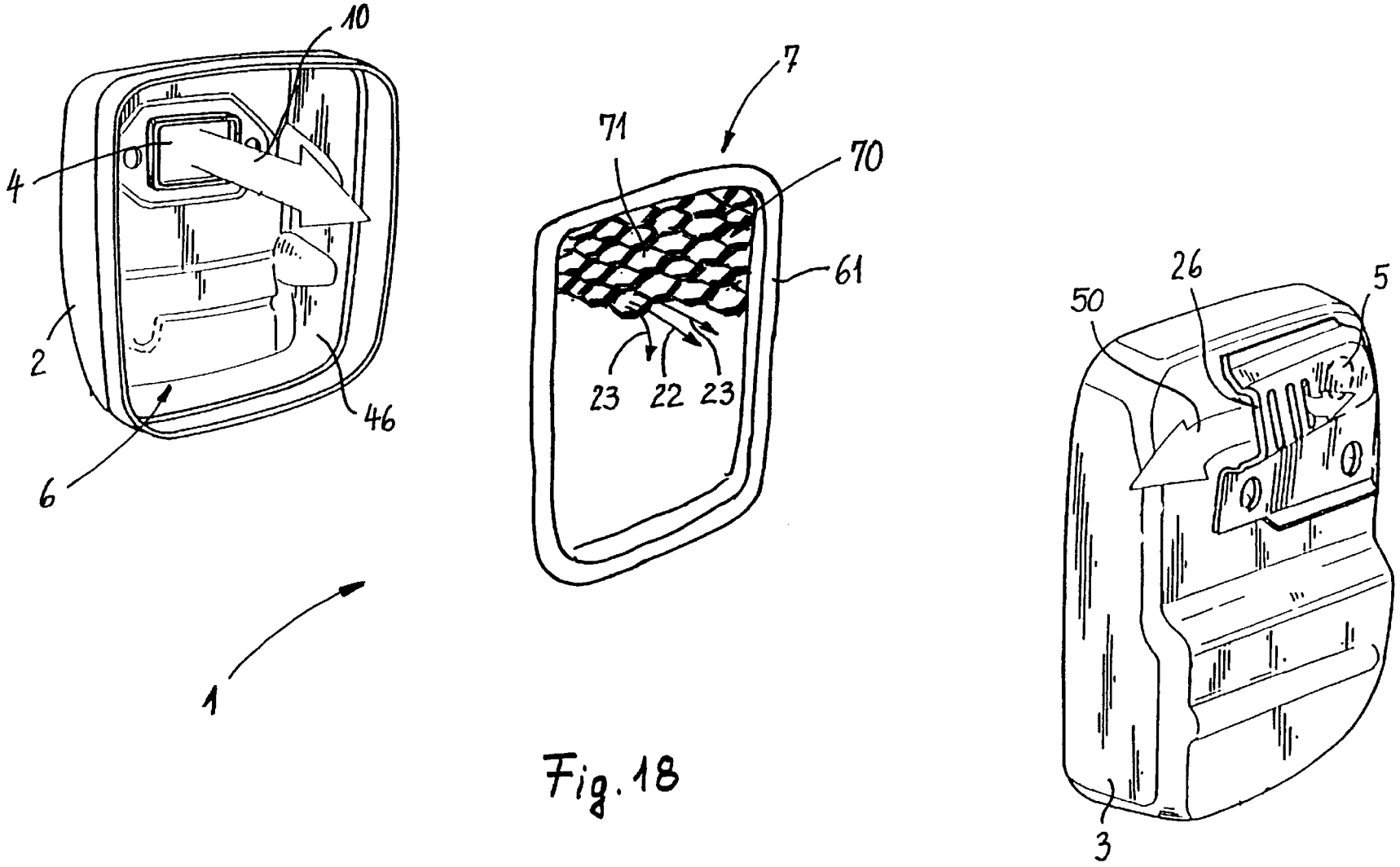
FIG. 18 shows an assembly schematic of another embodiment of an exhaust-gas muffler.

In the embodiment of FIG. 18, an expanded metal 70 of catalytic converting coated material is held in a frame 61 clamped tightly into the housing partition plane. The expanded metal partitions the inner space 6 of the muffler housing into an inlet end chamber 11 and an outlet end chamber 12. The exhaust gas, which flows in in the inflow direction 10, impinges upon the expanded metal lying transversely to the inflow direction and the exhaust-gas flow passes directly through the openings 71 in the expanded metal. These openings 71 are relatively large so that one can assume that the component flows 23, which lie next to the expanded metal, are catalytically treated; whereas, the exhaust-gas component flow 22, which flows essentially centrally through the opening 71, remains untreated. The treated exhaust-gas component flow 23 and the untreated exhaust-gas component flow 22 are closely mixed in the outlet end chamber 12 of the muffler housing and, as a mixed exhaust-gas flow 50, exit via the outlet 5 and the outlet scoop 26 into the ambient.

Figure 19:
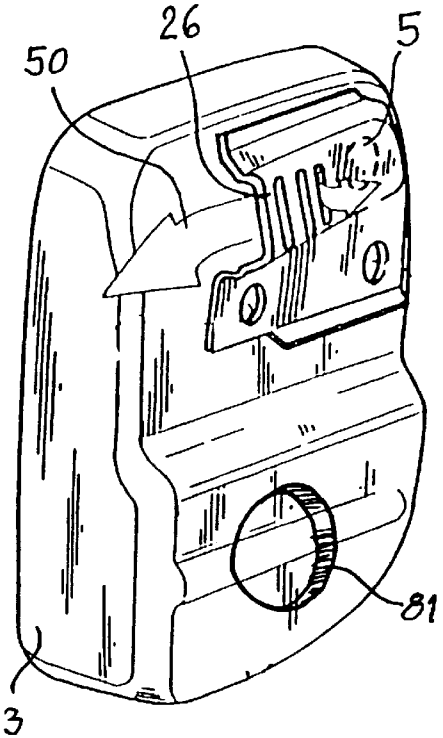
FIG. 19 shows an assembly schematic of a last embodiment of an exhaust-gas muffler.
Figure 19:
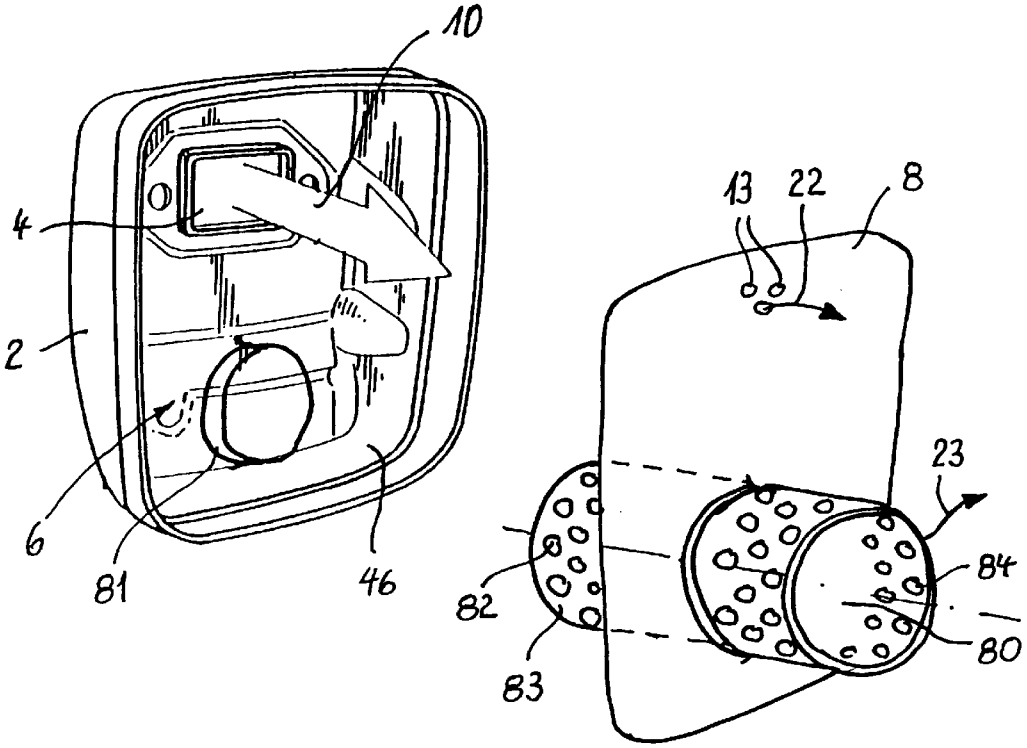

In the embodiment of FIG. 19, a pipe is held in the partition wall 8 which subdivides the muffler housing into an inlet end chamber 11 and an outlet end chamber 12. The pipe is perforated in its outer periphery in the manner of a showerhead and is pushed onto holding rings 81 at its ends. These holding rings 81 lie fixed on the respective bases of the housing shells 2 and 3. The bases of the housing shells close the pipe 80 at its ends. A flow passover from the inlet end chamber 11 to the outlet end chamber 12 is only possible via the pipe. The pipe 80 carries a catalytic converting coating or is made of a catalytic converting material.

The exhaust gas, which flows in in the inflow direction 10, enters into the pipe via the openings 82 in the pipe surface 83 and flows along the pipe and flows out through openings 84 provided in the pipe wall 83 in the outlet end chamber 12.

Advantageously, connecting openings 13 are provided in the partition wall 8 between the chambers 11 and 12, via which an untreated component flow 22 of the exhaust gas can flow to the outlet 5. In the outlet end chamber 12, the component flows 23 of treated exhaust gas (exiting from the catalytic converting pipe 80) therefore mix with the component flows 22 of untreated exhaust gas (entering via the connecting opening 13) and pass over as a mixed exhaust-gas flow 50 from the outlet 5 into the exit scoop 26.

Figure 20:
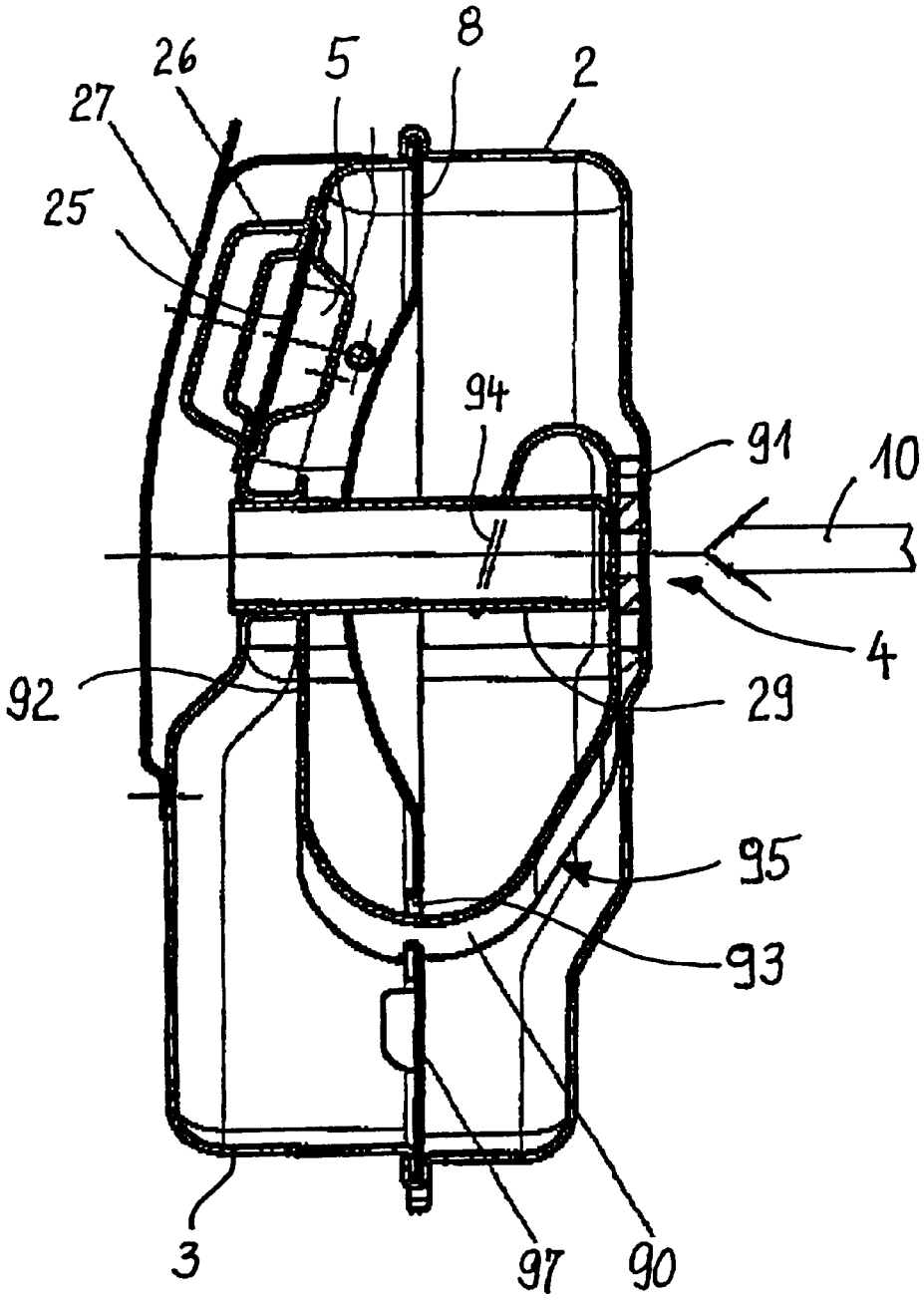
FIG. 20 shows a section view corresponding to FIG. 2 through a further embodiment of an exhaust-gas muffler.

The embodiment shown in FIG. 20 corresponds in its configuration approximately to the embodiment of FIG. 2. For this reason, the same reference numerals are used for the same parts. The operating principle corresponds to the embodiments of FIGS. 15 and 16 according to which the exhaust-gas flow, which enters in the direction 10, flows along a conducting wall 95 coated with catalytic converting material. The conducting wall 95 is mounted as a sheet metal strip 90 in the housing of the exhaust-gas muffler. The sheet metal strip 90 lies with one end 91 flat against the housing shell 2 at the inlet end and passes through a flow slit 93 in the intermediate wall 8 and lies with the other end 92 flat against the base of the housing shell 3. In the side view, the sheet metal strip 90 is bent to have a U-shape and the legs form the ends (91, 92). The end 91 has an opening which is coincident to the exhaust-gas inlet 4 and has an end section 94 bent over at an angle transversely to the inflow direction 10. The end section 94 engages between the receiving sleeves 29 which, in turn, project through the end 92 of the sheet metal strip 90. Approximately at the height of the exhaust-gas inlet 4, the intermediate wall 8 has a spherical shell-like projection 96 in the outlet end chamber 12. It is purposeful to provide a connecting opening 97 for the chambers (11, 12) in the intermediate wall 8. The connecting openings 97 operate as a bypass to the flow slit 93.

The exhaust gas, which flows in in the inflow direction 10 is first disturbed and swirled by the end section 94 which projects into the flow path. The exhaust gas impinges on the spherical shell-shaped projection 96 which operates as a deflecting surface. The gas pressure, which builds up in the inlet end chamber 11, effects a flow along the conducting wall 14 through the flow slit 93 and into the outlet end chamber 12. The exhaust gas, which comes into contact with the sheet metal strip 90, is converted. Parallel thereto, a substantially untreated exhaust-gas component flow passes through the connecting opening 97. The component flows, which enter into the outlet end chamber, become mixed and partially again have contact with the section of the sheet metal strip 90 which lies in the outlet end chamber and leave the housing via the exhaust-gas outlet 5 as already described.

Figure 21:
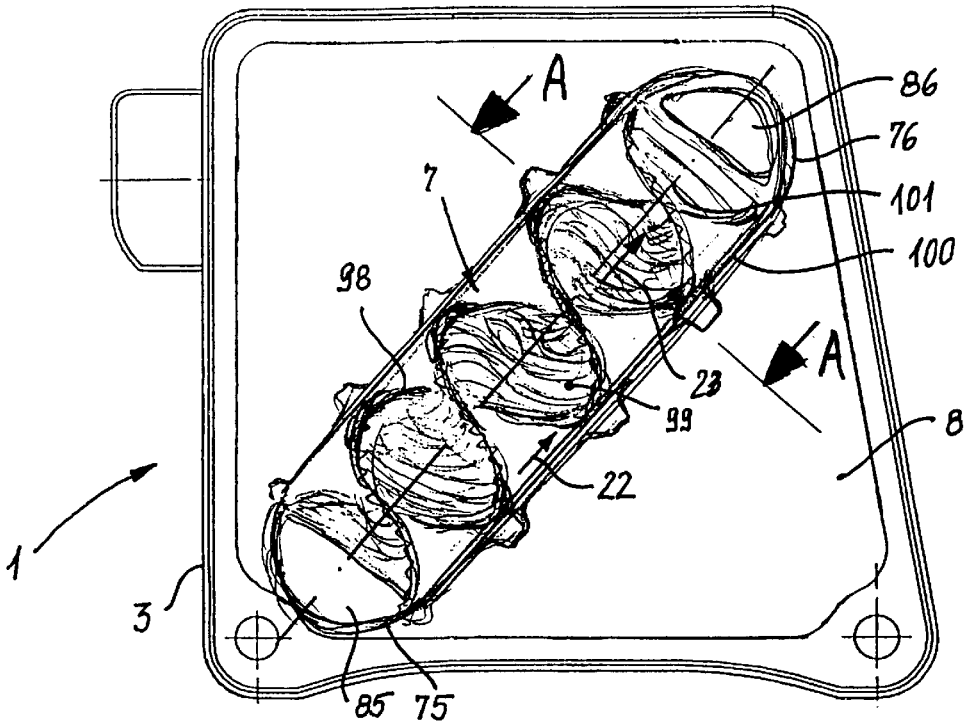
FIG. 21 shows a section through an exhaust-gas muffler having a catalytic converting sheet metal piece within an inner flow pipe; and, FIG. 22 shows a section view taken along line A—A of FIG. 21.
Figure 22:
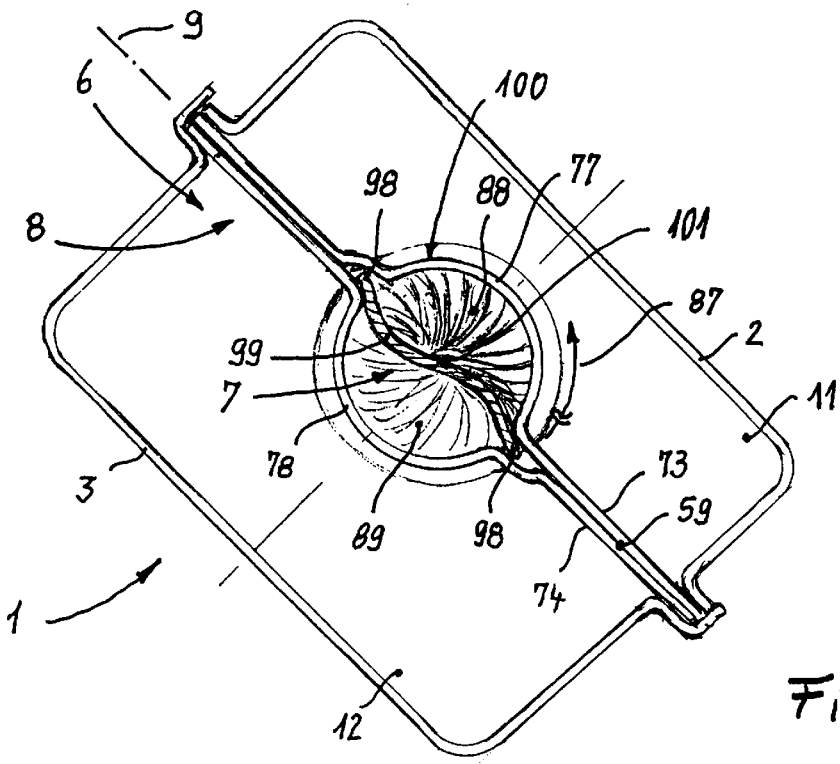

The exhaust-gas muffler, which is shown in FIGS. 21 and 22, comprises, in its basic configuration and in correspondence to the previously described embodiments, a housing 1, which is assembled from housing shells 2 and 3. An exhaust-gas inlet, which is not shown in detail, is provided in the base of the housing shell 2; whereas, the exhaust-gas outlet 5 is provided in the base of the housing shell 3. The exhaust-gas outlet 5 is covered by an exit scoop 26 (FIG. 21). The interior space 6 of the exhaust-gas muffler is subdivided by a partition wall 8 into an inlet end chamber 11 and an outlet end chamber 12 transversely to the throughflow direction of the exhaust gas. The intermediate wall 8 comprises two component walls 73 and 74 which lie approximately parallel to each other. The intermediate wall 8 is held clamped between the edges of the housing shells 2 and 3 in the housing partition plane 9.

A flow pipe 100 is attached to the intermediate wall 8 and connects the chambers 11 and 12 with each other. The flow pipe lies approximately parallel to the intermediate wall. In the embodiment shown, the flow pipe 100 is formed of two pipe halves 77 and 78 and is held between the component walls 73 and 74. The one pipe half 77 of the flow pipe 100 is configured as one piece with the one component wall 73 and the other pipe half 78 is configured as one piece in the other component wall 74. The component walls 73 and 74 are configured to have the same size and lie coincident to each other. The flow pipe 100 is formed of the two pipe halves 77 and 78 and lies approximately diagonally to the surface of the intermediate wall 8 in order to make possible a maximum length of the flow pipe 100. As indicated in FIG. 21, the one end 75 of the flow pipe 100 is provided with an inlet opening 85 and the end 75 lies in a corner of the muffler housing 1. The flow pipe is connected to the chamber 11 via the inlet opening 85. On the other end 76, an exit opening 86 is provided which connects with the other chamber 12. The end 76 lies in the diagonally opposite corner of the muffler housing 1.

A catalytic converting sheet metal piece 99 preferably coated on both sides is mounted as a catalytic converting element 7 in the flow pipe 100. The catalytic converting sheet metal piece 99 extends in the longitudinal direction of the flow pipe 100 essentially from the entry opening 85 to the exit opening 86 and is held in the flow pipe 100 in the region of its longitudinal edges 98. As FIG. 22 shows, component regions of the longitudinal edges 98 of the catalytic converting sheet metal piece 99 are held clamped in the region of the partition plane 59 between the pipe halves 77 and 78 of the component walls 73 and 74. It is sufficient that the longitudinal edges 98 are held in respective component regions in the elevation of the partition plane 59 as shown in FIG. 21.

As especially shown in FIG. 22, the flow pipe 100 is subdivided by the catalytic converting sheet metal piece 99 into essentially two spatially separate flow paths 88 and 89. The flow paths 88 and 89 extend in the longitudinal direction of the flow pipe 100 from the entry opening 85 up to the exit opening 86. The catalytic converting sheet metal piece 99 is advantageously twisted about the longitudinal center axis 101 of the flow pipe 100 in a spiral shape or screw-like shape. The twisting from the inlet end to the outlet end is configured to be uniform. In the embodiment shown, the catalytic converting sheet metal piece 99 is twisted over a twist angle 87 of 720°. The twist angles suitably lie between 540° and 900° depending upon the possible length of the flow pipe 100, that is, depending upon the diagonal structural size of the exhaust-gas muffler 1.

The exhaust-gas flow subdivides into a first component flow 23 and into a second component flow 22 over the length of the flow pipe 100 because of the spacing of the catalytic converting sheet metal piece 99 to the walls of the pipe halves 77 and 78. The first component flow 23 flows in contact with the catalytically converting coated surfaces of the catalytic converting sheet metal piece 99 and the second component flow is essentially close to the wall of the pipe halves 77 and 78 without direct contact with the catalytic converting sheet metal piece 99. In the region of the exit opening 86, the component flows 22 and 23 are deflected essentially by 90° approximately perpendicular to the intermediate wall 8 and enter into the outlet end chamber 12. Here, a close mixing of the component flows 22 and 23 takes place. The component flows 22 and 23 then leave the exhaust-gas outlet 5 of the muffler housing 1 as a mixed flow.

What is claimed is:

1. An exhaust-gas muffler on an internal combustion engine of a work apparatus including a motor-driven chain saw, the engine having an exhaust-gas channel through which the exhaust gas is discharged, the exhaust-gas muffler comprising:

a muffler housing including first and second housing shells;

said first housing shell having an exhaust-gas inlet communicating with said exhaust-gas channel for receiving the inflowing exhaust gas flow;

said muffler housing including an exhaust-gas outlet for conducting the exhaust gas out of said muffler housing;

a catalytic converting element disposed between said exhaust-gas inlet and said exhaust-gas outlet; and, means for guiding a first component flow of said inflowing exhaust-gas flow in contact with said catalytic converting element and a second component flow of said inflowing exhaust gas flow essentially without contact with said catalytic converting element and for bringing said first and second component flows together and for mixing said component flows together before said component flows exit through said exhaust-gas outlet from said housing.

2. The exhaust-gas muffler of claim 1, wherein the exhaust-gas flow is subdivided immediately after entry into the muffler housing into said first component flow and said second component flow.

3. The exhaust-gas muffler of claim 1, said guiding means including at least one conducting wall connected to the exhaust-gas inlet and guiding the exhaust-gas flow.

4. The exhaust-gas muffler of claim 3, wherein the conducting wall extends through the muffler housing in the inflow direction of the exhaust gas and lies against the housing shells.

5. The exhaust-gas muffler of claim 4, wherein the conducting wall is defined by an inlet pipe having a pipe surface in which a plurality of outflow openings is introduced in the form of a showerhead.

6. The exhaust-gas muffler of claim 5, wherein the inlet pipe has an approximately oval cross section and is closed at its ends by the housing shells; and, receiving sleeves for assembly screws, the receiving sleeves pass through the inlet pipe and are arranged especially parallel to the longitudinal axis of the inlet pipe.

7. The exhaust-gas muffler of claim 6, wherein a part of the outflow openings opens into the catalytic converting element which is carried by the conducting wall configured as an inlet pipe.

8. The exhaust-gas muffler of claim 1, wherein the catalytic converting element is made of a housing pot which includes a catalytically effective material and is made of a catalytically converting coated material.

9. The exhaust-gas muffler of claim 8, wherein said muffler housing includes an intermediate wall which partitions the interior space of the muffler housing transversely to the inflow direction of the inflowing exhaust gas flow into first and second chambers separate from each other, the chambers communicating with each other via connecting openings in the intermediate wall; and, the inlet pipe projects through the intermediate wall and the outflow openings open into the first chamber and the second chamber.

10. The exhaust-gas muffler of claim 9, wherein the catalytic converting element lies in the intermediate wall and the treated exhaust gas can flow off into the first chamber and/or the second chamber.

11. The exhaust-gas muffler of claim 1, wherein said guiding means comprises: two conducting walls arranged to lie approximately parallel to each other; the conducting walls delimiting an inlet shaft into which the exhaust-gas inlet opens; and, at least one of the conducting walls carrying a coating of a catalytic converting material.

12. The exhaust-gas muffler of claim 11, wherein receiving sleeves are arranged in the inlet shaft for assembly screws; the receiving sleeves extend through the muffler housing and fill the distance (a) between the conducting walls with a pregivable play (s); and, showerhead-like outflow openings are formed in at least one of the conducting walls.

13. The exhaust-gas muffler of claim 12, wherein said guide means includes an intermediate wall which partitions the inner space of the muffler housing transversely to the inflow direction of the exhaust gas flow into inlet end and outlet end chambers, which communicate with each other via a connecting opening; and, an inlet shaft projects through the intermediate wall and the outflow openings open into the inlet end chamber.

14. The exhaust-gas muffler of claim 13, wherein the conducting walls form legs of a U-shaped bracket having a base leg which has an inflow opening lying coincident to the exhaust-gas inlet.

15. The exhaust-gas muffler of claim 1, wherein said housing comprises an intermediate wall which partitions the inner space of the muffler housing transversely to the inflow direction of the exhaust gas flow into an inlet end chamber and an outlet end chamber separate from each other; the intermediate wall has first and second connecting openings between the two chambers and, the catalytic converting element is mounted in the flow path of a connecting opening and lies in the outlet end chamber.

16. The exhaust-gas muffler of claim 15, wherein the catalytic converting element comprises a plurality of catalytic converter sheet metal pieces lying approximately parallel to each other; the catalytic converting sheet metal pieces are inserted via holding flags formed thereon in receiving slits of a holding angle and are assembled to a component unit and lie approximately perpendicularly to the intermediate wall and the holding angle is fixed at the intermediate wall.

17. The exhaust-gas muffler of claim 15, wherein the second connecting openings open between the catalytic converter sheet metal pieces and throughflow openings are formed in the catalytic converting sheet metal pieces.

18. The exhaust-gas muffler of claim 15, wherein said guide means comprises the conducting wall as an interior wall to subdivide the muffler housing in the inflow direction of the exhaust gas flow and the exhaust gas is guided transversely to the inflow direction along the conducting walls from the exhaust-gas inlet to the exhaust-gas outlet; the conducting wall is transverse to the inflow direction of the exhaust gas flow and lies at a distance (y) to the wall of said muffler housing.

19. The exhaust-gas muffler of claim 18, wherein the exhaust-gas flow is guided transversely to the inflow direction in a partially circular-shape or spiral-shape about the exhaust-gas inlet to the exhaust-gas outlet.

20. The exhaust-gas muffler of claim 1, said muffler housing including an intermediate wall which partitions the inner space of the muffler housing transversely to the inflow direction of the exhaust gas into two separate chambers; and, said guide means comprising a flow pipe held on the intermediate wall and connecting the chambers to each other; said catalytic converting element including a catalytic converting sheet metal piece, which is coated on both sides; the catalytic converting sheet metal piece extending in the longitudinal direction of the flow pipe and is held in the flow pipe in the region of its longitudinal edges.

21. The exhaust-gas muffler of claim 20, wherein the flow pipe is subdivided by the catalytic converting sheet metal piece essentially into two spatially separate flow paths which extend in the longitudinal direction of the flow pipe.

22. The exhaust-gas muffler of claim 21, wherein the catalytic converting sheet metal piece is twisted about the longitudinal center axis of the flow pipe in a screw shape and is preferably uniformly twisted.

23. The exhaust-gas muffler of claim 22, wherein the catalytic converting sheet metal piece has a total angle of rotation of approximately 540° to 900° over the length of the flow pipe.

24. The exhaust-gas muffler of claim 23, wherein the flow pipe, at one end, has an entry opening connected to the one chamber and, at the other end, has an exit opening connected to the other chamber; and, the catalytic converting sheet metal piece extends essentially from the entry opening to the exit opening.

25. The exhaust-gas muffler of claim 24, wherein the flow pipe lies approximately parallel to the intermediate wall.

26. The exhaust-gas muffler of claim 25, wherein the inter mediate wall comprises two component walls which are approximately parallel to each other and the flow pipe is held between the component walls.

27. The exhaust-gas muffler of claim 26, wherein the flow pipe is assembled from two pipe halves; the one pipe half is preferably configured as one piece in the one component wall and the other pipe half is preferably configured as one piece in the other component wall.

28. The exhaust-gas muffler of claim 27, wherein the longitudinal edges of the catalytic converting sheet metal piece are held clamped between the pipe halves in the region of the partition plane.

* * * * *

UNITED STATES PATENT AND TRADEMARK OFFICE

CERTIFICATE OF CORRECTION

PATENT NO. : 6,393,835 B1
DATED : May 28, 2002
INVENTOR(S) : Gerhard Stoll et al.

It is certified that error appears in the above-identified patent and that said Letters Patent is hereby corrected as shown below:

Column 3,
Line 17, after "3", insert a comma.
Line 24, delete "walls" and substitute -- wall 8 -- therefor.

Column 5,
Line 27, "in let" should read -- inlet --.
Line 35, delete "(3)" and substitute -- (s) -- therefor.
Line 45, delete "B" and substitute -- 8 -- therefor.

Signed and Sealed this

Eighteenth Day of March, 2003

JAMES E. ROGAN
*Director of the United States Patent and Trademark Office*